US006600695B1

(12) United States Patent
Nugent et al.

(10) Patent No.: US 6,600,695 B1
(45) Date of Patent: Jul. 29, 2003

(54) METHOD AND APPARATUS FOR RETRIEVING AN UNMANNED UNDERWATER VEHICLE

(75) Inventors: David M. Nugent, Newport, RI (US); Thomas D. Barron, Newport, RI (US); Thomas A. Frank, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/224,228

(22) Filed: Aug. 19, 2002

(51) Int. Cl.[7] ..... B63G 8/00

(52) U.S. Cl. ..... 367/131; 340/850; 114/312; 114/316

(58) Field of Search ..... 367/131; 340/850; 114/312, 322, 253, 249, 316

(56) References Cited

U.S. PATENT DOCUMENTS 3,757,722 A * 9/1973 Seiple ..... 114/322
5,291,194 A * 3/1994 Ames ..... 340/850
5,396,859 A * 3/1995 Hillenbrand et al. ..... 114/312
5,398,636 A * 3/1995 Hillenbrand ..... 114/312
5,447,115 A * 9/1995 Moody ..... 114/312
5,748,102 A * 5/1998 Barron ..... 340/850

* cited by examiner

*Primary Examiner*—Ian J. Lobo
(74) *Attorney, Agent, or Firm*—James M. Kasischke; Michael F. Oglo; Jean-Paul A. Nasser

(57) ABSTRACT

A system and method is disclosed for retrieving an untethered submarine tube-retrievable UUV in which the untethered submarine tube-retrievable UUV may be retrieved through the torpedo tube of a submarine. The untethered submarine tube-retrievable UUV has a capture cable extending therefrom with a transducer to produce a homing signal. A tethered homing signal seeking UUV is guided toward the homing signal. Capture arms on the tethered homing signal seeking UUV engage the capture cable and guide the capture cable to one of several cable snagging eye-members. The winching cable is then winched back into the torpedo tube thereby drawing the untethered submarine tube-retrievable UUV into the torpedo tube.

20 Claims, 5 Drawing Sheets

METHOD AND APPARATUS FOR RETRIEVING AN UNMANNED UNDERWATER VEHICLE

STATEMENT OF THE GOVERNMENT INTEREST

The invention described herein may be manufactured and used by or for the Government of the United States of America for Governmental purposes without the payment of any royalties thereon or therefore.

BACKGROUND OF THE INVENTION (1) Field of the Invention

The present invention relates generally to retrieving an unmanned underwater vehicle and, more specifically, to apparatus and method for connecting to and retrieving an unmanned underwater vehicle through a torpedo tube of a submarine.

(2) Description of the Prior Art

Unmanned underwater vehicles (UUVs) may be used for numerous military and non-military purposes including surveillance either stationary or trailing, monitoring various types of sea traffic, monitoring animal and plant life, mapping, weapon systems, and the like, depending on the UUV instrumentation, sensor arrays and the like. In some cases, it will be desirable to retrieve the UUV to obtain stored intelligence, to update equipment, perform maintenance, and program for new missions. Although the UUV may be recovered by ship, it may also be desirable to recover the UUV by means of a submarine whereby the retrieval and recovery may be made entirely underwater.

Relatively complicated apparatus have been used in the past as discussed below to recover vehicles through the torpedo tube of a submarine including multiple pistons, sleeves, electrical connections and the like. It would be desirable to simplify such a procedure. As well, it would be desirable to provide a cable connection to the UUV rather than a male-female connection which may be more difficult to effect. Other patents listed below also provide information about UUVs and interconnection to a trailing cable but not for winching purposes.

U.S. Pat. No. 5,447,115, issued Sep. 5, 1995, to P. E. Moody, which is incorporated herein by reference, discloses an unmanned underwater vehicle recovery device being joinable with the breech of an existing torpedo tube. The recovery device comprises a plurality of concentric tubes which telescope through the torpedo tube to the exterior of the hull of a submarine to provide a mechanism for aligning the recovered unmanned underwater vehicle with the torpedo tube launchway. A recovery vehicle is held within the recovery device by a deployable tether. During recovery, the recovery vehicle is launched from the recovery device in the torpedo tube of the submarine. The recovery vehicle travels out and mates with a coupling at the rear of the unmanned underwater vehicle. The tether is retracted and the joined recovery vehicle/unmanned underwater vehicle is pulled into the torpedo tube launchway. The concentric tubes are retracted and the unmanned underwater vehicle is left in the torpedo tube.

U.S. Pat. No. 5,398,636, issued Mar. 21, 1995, to C. F. Hillenbrand, which is incorporated herein by reference, discloses a submarine that trails a fiber optic cable and an undersea vehicle that is controlled by the cable. A missile/torpedo trails a second cable that is to be coupled to the first cable. The second cable has a segment suspended vertically underwater between a buoyant pod and a sea anchor type buoy. The undersea vehicle, or Autonomous Undersea Vehicle (AUV), hunts for the pod by conventional homing components, and the cable capturing arms on the vehicle direct the cable's movement relative to the vehicle into a pod mating position that achieves optical coupling of the two cables. In one embodiment, two arms are pivotally mounted to the vehicle's sides so one arm captures the suspended cable segment directing it into a slot so a male socket in the underside of the pod mates with a female socket in the slot. Another embodiment accomplishes the same result with a device in which the arms are formed at offshoots of a forked cable pickup device in the noise of the AUV. However, in the area of the mechanism which affects the final bringing of the AUV into a directly coupled and mated position with the pod, the patentee's descriptions are indefinite, vague, and regarding certain points baffling, even including the possibility of extraction of information from his graphics. Providing the mechanical solutions for bringing a pod hunting UUV into a connected relationship with the pod via a cable trailing therefrom is difficult. The efforts of the patentee further involved a requirement to optically couple two fiber optic link terminals at the pod UUV interface, which further complicates the solution. The present invention overcomes these problems and is a solution in which the complication of coupling the fiber links is eliminated.

U.S. Pat. No. 5,396,859, issued Mar. 14, 1995, to Hillenbrand et al., which is incorporated herein by reference, discloses another embodiment of the device described above in U.S. Pat. No. 5,398,636.

U.S. Pat. No. 5,291,194, issued Mar. 1, 1994, to G. H. Ames, which is incorporated herein by reference, discloses an apparatus for interconnecting an unmanned underwater vehicle (UUV) and a free-floating pod. The apparatus comprises a communications cable extending between the pod and a less buoyant buoy, the buoy being in communication with a distal station, a mobile UUV in communication with a control vessel, connector structure on the UUV adapted to intercept the cable and adapted to slide along the cable toward the pod, and complementary engagement structure on the UUV and the pod adapted to cause the UUV to engage the pod in a preselected orientation and azimuth, to place the control vessel in communication with the distal station.

U.S. Pat. No. 3,757,722, issued Sep. 11, 1973, to R. L. Seiple, discloses a docking system that employs a haul down winch to recover and secure a swimmer delivery vehicle to the deck of a large submarine. A buoyancy system is used to deploy a haul down line in a vertical position extending above the submarine vehicle. An acoustic pulse transmitter provides guidance signals to direct the small swimmer delivery submersible to a point of engagement with the haul down line. An attachment means is secured to the line and cooperates with a capture socket carried on the nose of the submersible vehicle. A line capture and guidance device is also mounted on the nose of the submersible swimmer delivery vehicle to assist in attaching the vehicle to the haul down line.

In summary, while the prior art shows various systems relating to UUVs, the prior art does not provide a simplified system for attaching a cable to a UUV for winching the UUV aboard through a UUV receive tube, such as a torpedo tube of a submarine. Consequently, there remains a need for a system that may be used to connect with a trailing cable of a UUV for winching of the UUV into the torpedo tube. As an option, it would be desirable that the system provide for full use of the torpedo tube with virtually no modifications to the torpedo tube. Those skilled in the art will appreciate the present invention that addresses the above and other problems.

SUMMARY OF THE INVENTION

Accordingly, it is an object of the present invention to provide an improved method and apparatus for retrieving a UUV.

It is yet another object of the present invention to provide a means for attaching to a trailing cable of a UUV for hauling the UUV aboard a submarine.

These and other objects, features, and advantages of the present invention will become apparent from the drawings, the descriptions given herein, and the appended claims.

In accordance with the present invention, a method is provided for retrieving an untethered submarine tube-retrievable unmanned underwater vehicle (UUV). The untethered submarine tube-retrievable UUV has a capture cable extending therefrom. The capture cable has attached thereto, intermediate the first UUV and the capture cable's trailing end, a sender transducer unit for producing a homing beacon signal. The sender transducer unit may be housed in a pod which additionally serves the purpose of being a first mechanical jam. The capture cable further has attached at its trailing end an element for exerting a cable extending force on the capture cable. This element may serve as a second mechanical jam. The method may comprise one or more steps such as, for instance, attaching a winching cable to a tethered homing signal seeking unmanned underwater vehicle (UUV), launching the tethered homing signal seeking UUV from a UUV retrieve tube of a submarine. A winching cable towed by the tethered homing signal seeking UUV is guided to and physically secured, but not necessarily electrically or optically connected, to the capture cable. Other steps may comprise providing one or more capture arms that extend laterally from the tethered homing signal seeking UUV to form one or more respective apexes between the capture arms and a body of the tethered homing signal seeking UUV. In a preferred embodiment, a cable snagging eye-member is provided at each of the one or more apex. Each cable snagging eye-member has formed therein an eye-opening preferably of sufficient cross-sectional size to allow the cable snagging eye-member to freely slide along the capture cable when the capture cable is snagged therein. Other steps may comprise impinging a capture arm against the capture cable to guide the capture cable to a respective apex and into a snagged condition within the eye-opening of the cable snagging eye-member. The untethered submarine tube-retrievable UUV is retrieved by pulling the winching cable to slide the cable snagging eye-member along the capture cable until the capture cable engages the first mechanical jam or the second mechanical jam. Continued pulling hauls the untethered submarine tube-retrievable UUV into the UUV retrieve tube of the submarine.

In a preferred embodiment, the sender transducer unit and the force exerting element at the trailing end of the capture cable singly and collectively present substantially less inertial and drag resistance to a force to move them through water than an inertial and drag resistance which the untethered submarine tube-retrievable UUV presents, whereby the cable snagging eye-member will always slide along the capture cable toward the first mechanical jam or the second mechanical jam.

Other method steps may comprise providing a split in the winching cable with first and second ends, attaching the first end to a first cable snagging eye-member, and attaching the second end to a second cable snagging eye-member. In one preferred embodiment, the first and second cable snagging eye-members are detachable from the tethered homing signal seeking UUV.

The invention also provides a system for retrieving an untethered submarine tube-retrievable UUV, which may comprise one or more elements such as the submarine UUV retrieve tube, a capture cable trailing from the untethered submarine tube-retrievable UUV carrying a homing signal beacon, a tethered homing signal seeking UUV carrying a receiver transducer for receiving the homing beacon signal to guide the tethered homing signal seeking UUV toward the homing beacon signal and the capture cable, and a winching cable secured to the tethered homing signal seeking UUV and extendable through the UUV retrieve tube. A plurality of extendable capture arms are mounted to the tethered homing signal seeking UUV for engaging the capture cable, and a plurality of cable snagging eye-members mounted at respective apexes of the capture arms.

In one preferred embodiment, the plurality of cable snagging eye-members are respectively detachably mounted to a body of the tethered homing signal seeking UUV by means of sunderable fastening arrangements for retaining the plurality of cable snagging eye-members fastened to the body. The winching cable may be secured to the second tethered homing signal seeking UUV by a split cable arrangement connecting to a corresponding plurality of attachment points on the respective cable snagging eye-members, whereby a collective sundering of the plurality of fastening arrangements separates the plurality of cable snagging eye-members from the body of the tethered homing signal seeking UUV.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
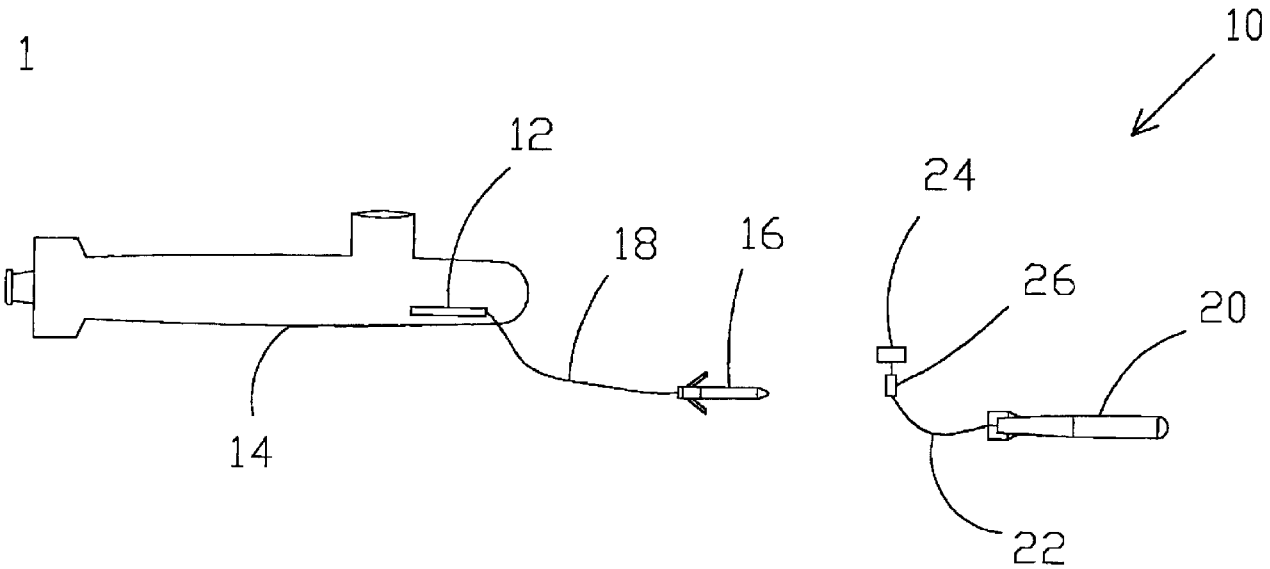
FIG. 1 is a schematic representation of a first untethered submarine tube-retrievable UUV and an initial deployment of a second tethered homing signal seeking UUV from a submarine UUV retrieve tube for a recovery operation in accord with the present invention.

Referring now to the drawings and, more particularly, to FIG. 1 there is shown a retrieval system 10 in accord with the present invention operable through torpedo tube 12 in submarine 14.

An unmanned underwater vehicle (UUV) 16 is launched from submarine 14 and is attached to winching cable 18 (and therefore tethered). In a preferred embodiment, cable 18 is simply a sturdy reinforced cable, for instance a steel or nylon cable, or coated cable reinforced with a reinforcing material such as steel or nylon, that may be used to winch a UUV 20 aboard submarine 14 through torpedo tube 12. Thu, in the preferred embodiment, it is not necessary to establish a seawater sealed electrical connection or optical connection to the UUV 16 or to establish another seawater sealed electrical rotary connection through a winch connector and to instrumentation within the submarine. Thus, the design is greatly simplified by using a reinforced winching cable without the need to establish electronic communications through the winching cable. Although in a preferred embodiment electronic communications between UUV 16 and submarine 14 are not necessary, acoustic communications could be conveniently established therebetween because UUV 16 will preferably have acoustic electronic equipment therein as discussed subsequently.

Figure 3:
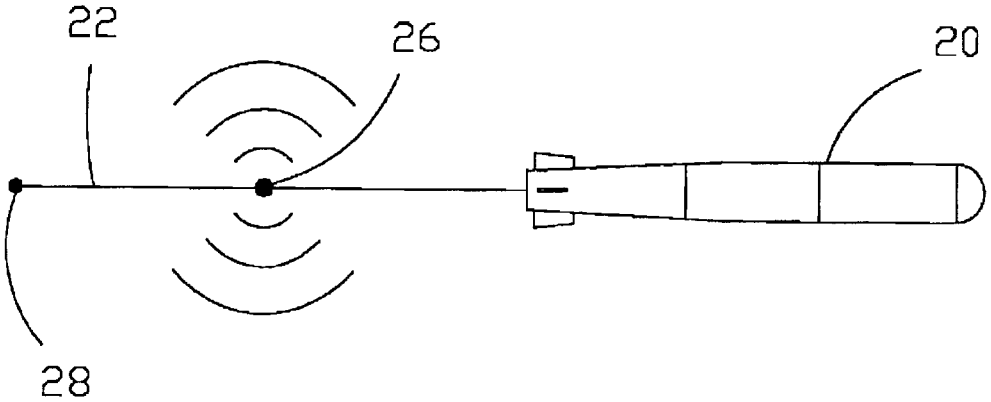
FIG. 3 is a schematic representation of a first unmanned underwater vehicle with a trailing capture cable in accord with another embodiment of the invention.

An untethered UUV 20, which is to be retrieved, is provided with a relatively short length of capture cable 22 extending therefrom. Cable 22 may be permanently deployed from UUV 20 or in some cases it may be desirable to provide means built within UUV 20 for deploying cable 22 at the time of retrieval. The general loci of capture cable 22 around transducer 26 is predetermined. Preferably attached to cable 22 are buoy 24 and transmitting transducer 26. Buoy 24 may, if desired, comprise a drogue that resists being pulled through water for reasons discussed hereinafter. Transducer 26 preferably has a case or pod to house an acoustic homing beacon transducer such that the case or pod may also act as a mechanical jam in one embodiment of the invention as discussed hereinafter. Buoy 24 may also act as a mechanical jam. While use of buoy 24 is desirable to extend cable 22 with respect to UUV 20, it is also possible to have cable 22 trail or stream behind UUV 20 if UUV 20 is moving as indicated in FIG. 3. Thus, in FIG. 3 water restriction element 28, which may be a drogue, may be used to extend cable 22 with respect to UUV 20 as UUV 20 moves. It is desirable to have cable 22 extended, preferably in a known manner around a general loci with respect to UUV 20 to enhance capture thereof by UUV 16. Instead of buoy 24, a weight could be utilized to extend the cable vertically downwardly with respect to UUV 20. Transducer 26 is preferably an acoustic transducer for use in sending an acoustic homing signal for receipt by UUV 16. Other types of homing signals could conceivably be used, e.g., a flashing light in relatively clear water to avoid need for acoustic transmissions.

Figure 2:
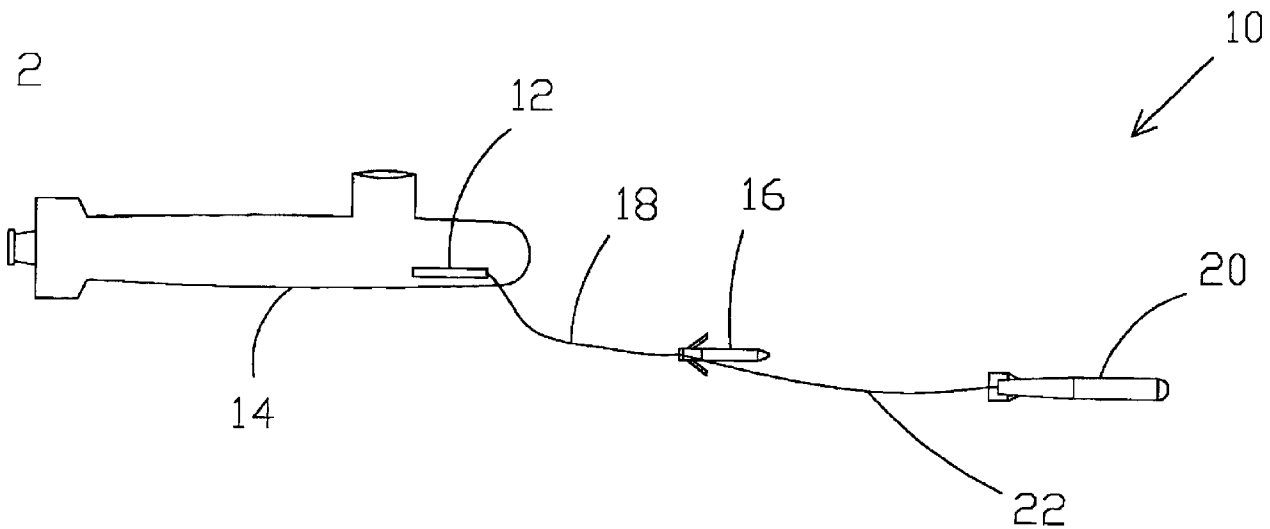
FIG. 2 is a schematic representation showing the first and second unmanned underwater vehicles in FIG. 1 being winched aboard a submarine in accord with the present invention.

In FIG. 2, cable 22 attached to UUV 20 has been captured by UUV 16 in a manner to be discussed subsequently and is being winched back into torpedo tube 12 of submarine 14. If the length of UUV 20 will take up substantially the entire length of torpedo tube 12, then several options are available for permitting this purpose which options may be combined. In one option, discussed hereinafter, UUV 16 is jettisoned thereby providing more room for UUV 20 within torpedo tube 12. As another option, a tubular extension to torpedo tube 12 may be added such as by connecting a tubular member to the torpedo tube breech door locking ring as taught by U.S. Pat. No. 5,447,115 referenced above and incorporated herein by reference but without the need for the complicated extendable piston system, tubular jettison system, and electrical interconnections as taught therein.

During winching procedures, it may be desirable for submarine 14 to move in a reverse direction with respect to a forward oriented torpedo tube 12 so as to keep cable 18 extended during winching to thereby orient cable 18 and UUV 20 for easier recovery into torpedo tube 12.

Figure 4:
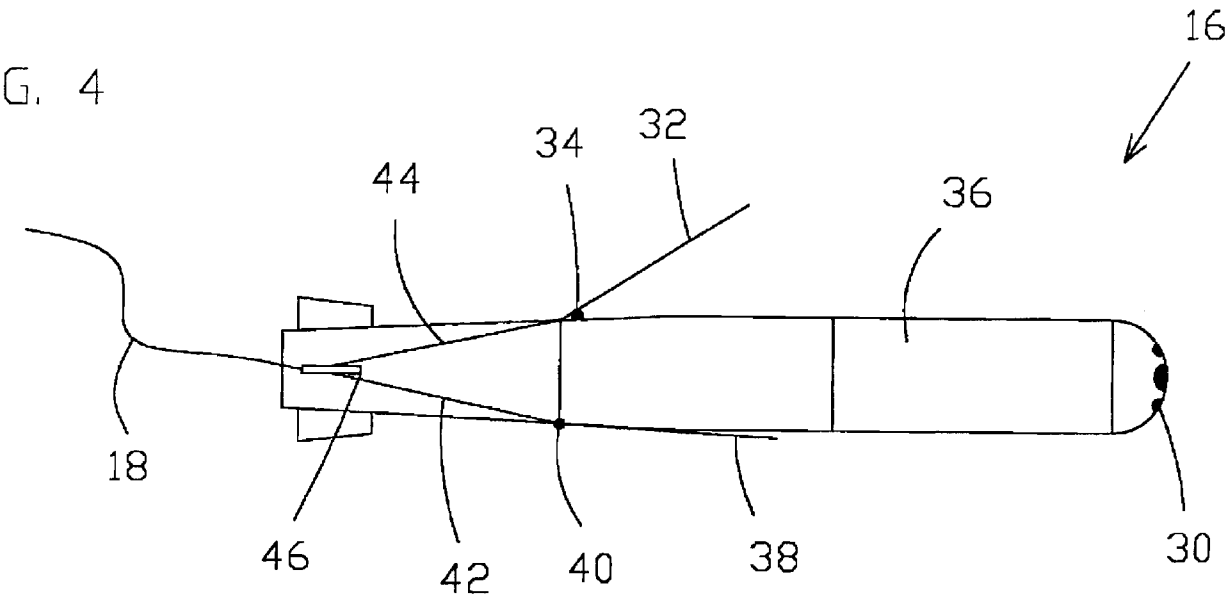
FIG. 4 is an elevational view of the second unmanned underwater vehicle of FIG. 1 in accord with the present invention.

FIG. 4 shows relevant enlarged features of UUV 16. UUV 16 includes acoustic homing sensors 30 that may preferably be located at the nose of UUV 16. By use of acoustic homing sensors 30, UUV 16 is automatically steered toward acoustic transducer 26 for capturing cable 22 that is secured to UUV 20.

Extendable capture arms 32 and 38 are used to capture and guide cable 22 of UUV 20 into cable snagging eye-member mechanism 34 disposed at the apex of the angle between capture arm 32 and body 36 of UUV 16 and discussed subsequently with respect to FIG. 5. Capture arms are preferably spring-loaded so that they deploy to an open position as shown by arm 32 after UUV 16 exits torpedo tube 12. The stowed position is as shown by capture arm 38 which is closed with respect to body 36. While two capture arms are shown in UUV 16 in FIG. 4, a typical arrangement may also include three or four capture arms. If the orientation of capture cable 22 is known, then the capture arms can be positioned accordingly, e.g., if capture cable extends vertically, then the capture arms may be located on the sides of UUV 16 and UUV 16 programmed to maintain that orientation such as with a gravity orientation control. Alternatively, three capture arms could be utilized so as to snag capture cable 22 regardless of its orientation.

Cable 18 preferably attaches with a split or bifurcated end connection to cable snagging eye-members 34 and 40. Preferably, cable 18 may engage a rear fin, such as fin 46 and then split into two lengths 42 and 44 for connection with cable snagging eye-members 34 and 40 whereby the origin of the split engages the rear end of fin 46 and the length of split cable ends 42 and 44 is designed to hold the split in contact with the rear end of fin 46. Fin 46 may be between other fins that are aligned respectively with cable snagging eye-members 34, 40. In embodiments wherein tethered UUV 16 is propeller driven, the aft ends of the fins are preferably located at a position far enough forward along the taper of the tailcone to provide a tailcone diameter which exceeds the diameter of the propeller's circle of revolution. This arrangement helps keep cable 18 away from any propellers that may be used with UUV 16. Other propulsion means such as jet pumps could be used for propelling UUV 16. In one embodiment of the invention, cable snagging eye-members 34 and 40 may break away from body 36 of UUV 16 to permit additional room in torpedo tube 12 and any extensions thereof for the size of UUV 20.

Figure 5:
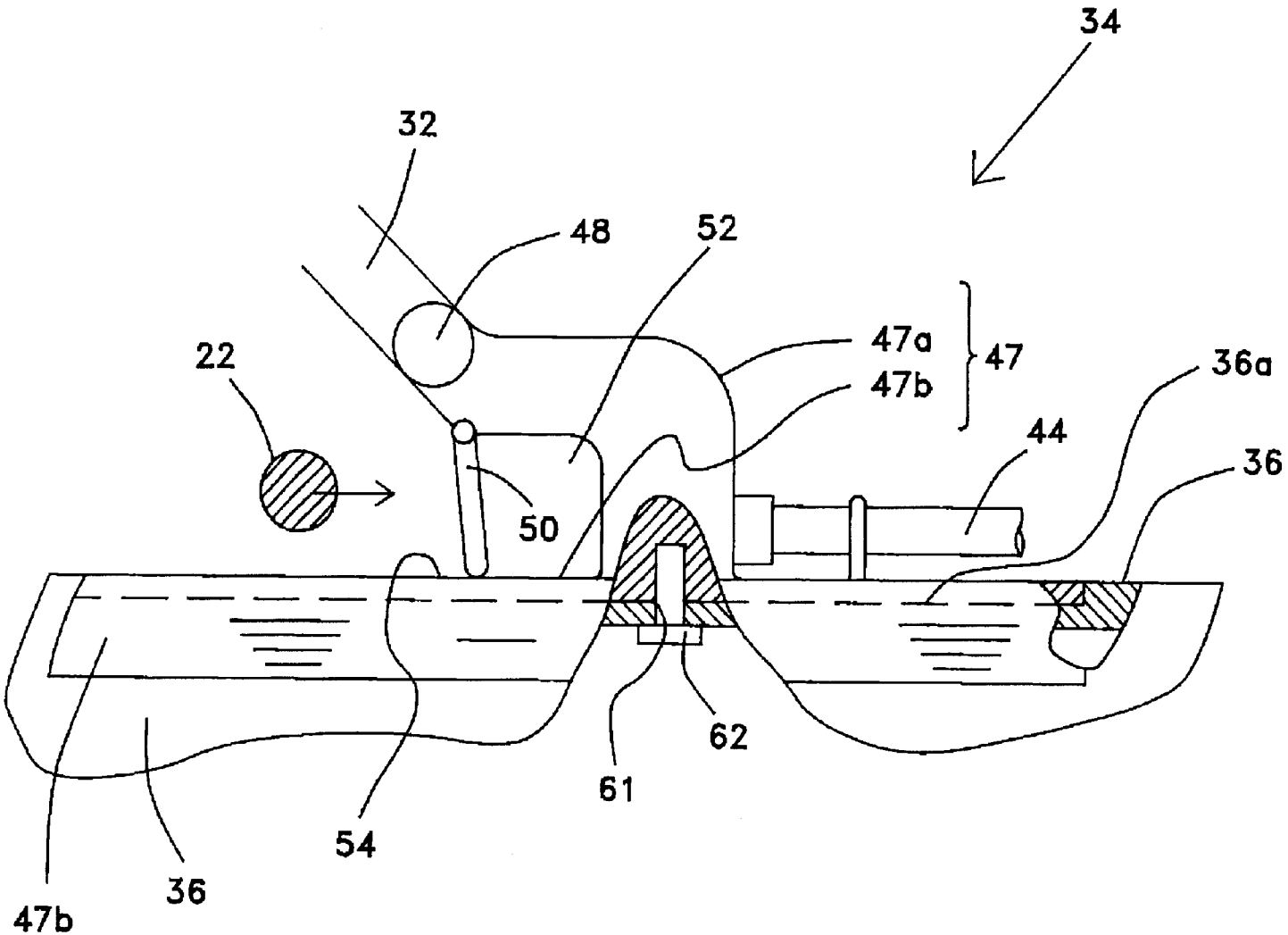
FIG. 5 is an elevational view, partially in section, showing a cable snagging eye-member member in accord with the present invention.
Figure 6:
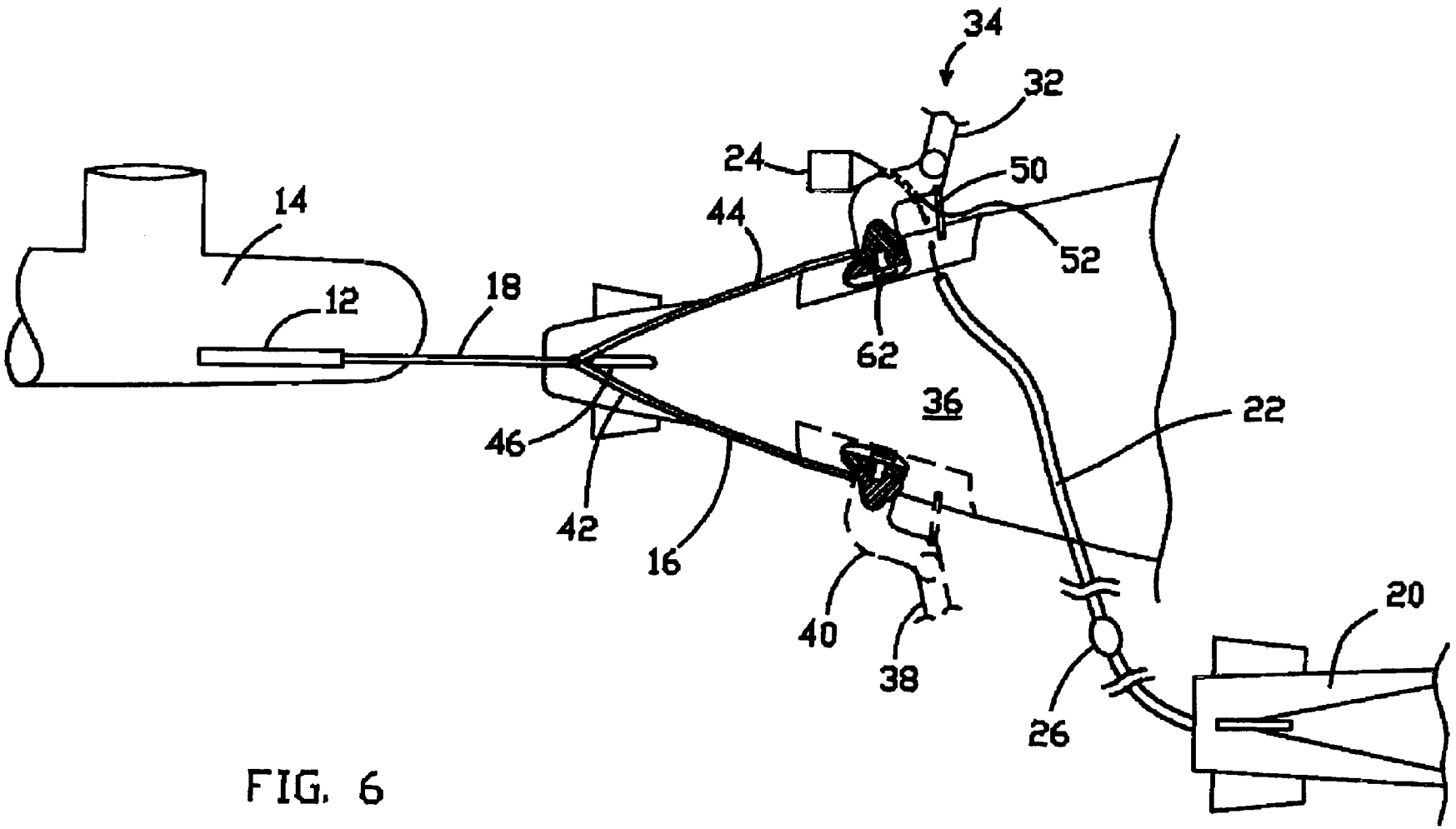
FIG. 6 is an elevational view showing operation whereby the cable snagging eye-member engages the trailing capture cable of the first UUV.
Figure 7:
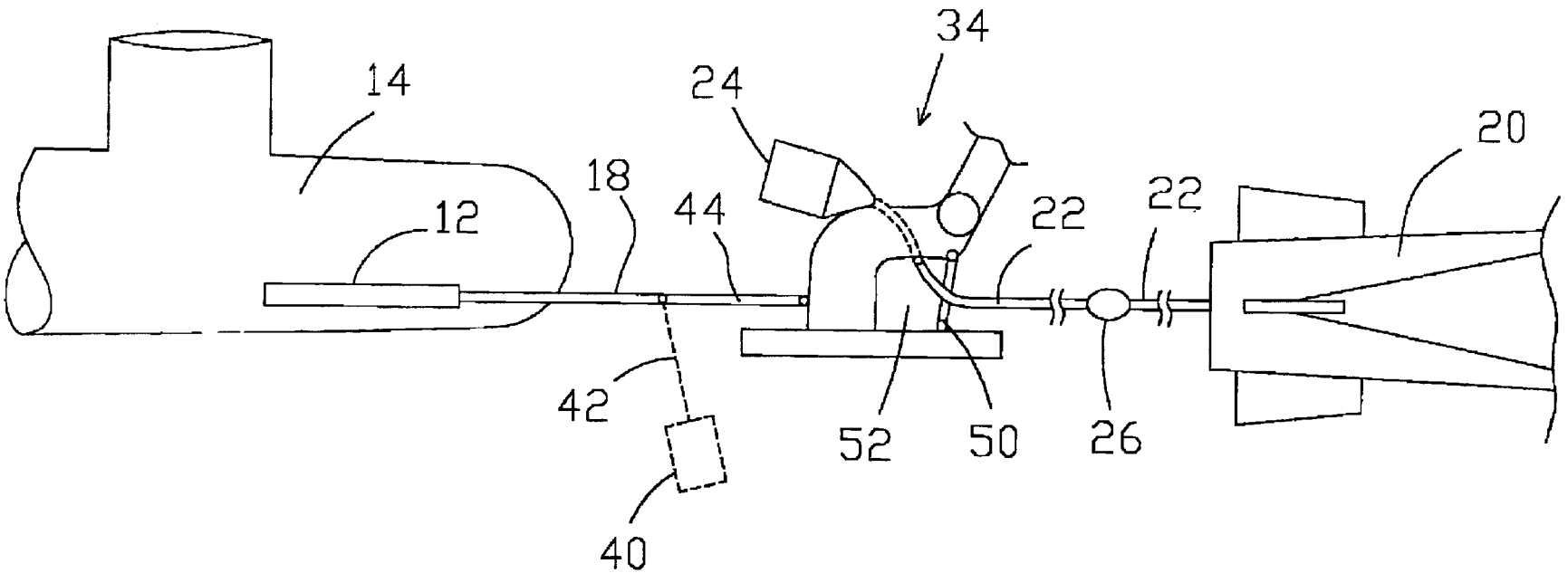
FIG. 7 is an elevation view showing one embodiment of operation whereby the snagging eye-members are separable from the second UUV and the second UUV is disposable to permit greater room for the first UUV in the UUV retrieve tube.

FIG. 5 shows one possible embodiment of cable snagging eye-member 34 that may be used to capture cable 22 of UUV 20. However, it will be understood that snagging eye-member 34 may have many different constructions. Cable snagging eye-member 34 is located at the base of arm 32. In the embodiment shown in FIG. 5 cable snagging eye-member 34 includes a bracket element 47 having a hook-shaped portion 47*a* and a base portion 47*b*. Formed in the body 36 of tethered UUV 16 is a recess 36*a*. (This recess shows in the drawing as a dashed line along the majority of the length of base portion 47*b*, and in those locations of the view which have been out away to expose underlying cross sections, the recess shows a solid line.) Base portion 47*a* is seated in recess 36*a*. Arm 32 may be connected to hook-shaped portion 47*a* of bracket element 47 by spring-loaded hinge 48. Arm 32 guides capture cable 22 towards spring-loaded, or resilient trigger or clip 50 for capture therein as indicated in FIG. 6 and FIG. 7. In this embodiment, a carabiner type of snagging eye-member may be used whereby spring-loaded clip 50 bends inwardly by pressure of cable 22 being guided by arm 32 to permit cable 22 to be guided into an eye-opening, or ring 52. Once capture cable 22 is inside ring 52, then spring-loaded clip 50 moves to the closed position as shown. Because spring-loaded clip 50 is prevented from moving outwardly by stop surface 54, cable 22 cannot come free and cable 22 is captured. The inner diameter of ring 52 may be designed to be larger than the diameter of cable 22 to permit relative sliding of the snagging eye-member with respect to capture cable 22. As UUV 16 is winched and snagging eye-member 34 is winched toward submarine 14, eye-member 34 may slide with respect to cable 22, until it jams against either transducer pod 26, as show in FIG. 6, or buoy 24. As mentioned above, transducer pod 26 and buoy 24 may comprise enlargements to act as jam mechanisms. Other jam mechanism could also be mounted to cable 22. In one embodiment transducer 26 and buoy 24 have less inertia and drag than UUV 20 so that the cable snagging eye-member always slides along capture cable 22 in a direction toward its terminal end in response to tension on winching cable 18. Once snagging eye-member 34 is jammed against a jam mechanism as shown in FIG. 7, then cable 22 is effectively captured and may be pulled with cable 18.

In one embodiment of the present invention, body 36 may be jettisoned. The advantage of this is to permit extra room within UUV capture tube 12 for UUV 20. This goal may be effected in different ways. In one embodiment cable snagging eye-members are releasably attached to body 36 of UUV 16. Each end of the split cable may then connect to a respective cable snagging eye-member. For instance, split cable 44 may preferably connect directly to snagging eye-member 34. The cable snagging eye-member is releasably attached to body 36 such as by any releasable means including explosive bolts, electrically controllable latches, or the like. As another example, shear member 62 may be utilized for connecting cable snagging eye-member 34 to body 36 such that shear member 62 shears when a sufficient force is applied to constricted portions 61 of shear member 62. The required force may be designed based on the weight and drag of UUV 16 so that shear bolts, pins, or studs can be appropriately selected. Buoy 24 may be provided as a drogue or an element resistant to force. As a result of pulling cable 18, shear members 62 are sheared and cable snagging eye-member 34 is released from body 36 of UUV 16. Cable snagging eye-member 34 is attached directly to the end of split cable 44 to thereby connect winching cable 18 to capture cable 22. In conjunction with this or in another embodiment, a latch pin (not shown) could be disengaged by a latch arm (not shown) that pivots when cable 22 enters ring 52. Once UUV 16 is jettisoned, there is more room in torpedo tube 12 and any tubular extensions thereof for UUV 20 as discussed above.

FIG. 6 shows more clearly the action of capturing capture cable 22 in one embodiment of the invention. As UUV 16 is guided toward UUV 20 as discussed above, capture cable 22 enters through resiliently mounted trigger or pin 50 into an eye-opening 52 of cable snagging eye-member 34. Since eye-opening 52 in this embodiment preferably has a larger inner diameter than a diameter of capture cable 22, cable snagging eye-member 34 slides easily along capture cable 22 when winching cable 18 is pulled toward an enlargement in capture cable 22 such as float 24 which acts as a jam mechanism.

In the embodiment of FIG. 7, UUV 16 is jettisoned. After one of snagging eye-members 34 or 40 engages a jam mechanism, such as buoy 24, continued pulling on winching cable 18 creates a force that shears shear bolts 62 which are used to attach each of snagging eye-members 34, 40 to body 36 of UUV 16. The design force causing shear bolts 62 to be sheared (and therefore resulting in UUV 16 being jettisoned) is any predetermined magnitude of force significantly less than that required for overcoming the inertial and drag resistance of the body 36 of UUV 16. All the snagging eye-members are secured by collectively sunderable attaching mechanisms comprising shear bolts 62. Since some of the snagging eye-members do not engage capture cable 22, they simply hang from the bifurcated end, such as remaining snagging member 40, as indicated in dash, which hangs off bifurcated end 42. Note that while shear bolts may be utilized, other means such as electrically controlled releasable latches or other means may be utilized for collectively separating all snagging eye-members from body 36. For instance, upon receiving a certain acoustic signal, or upon contact with a pressure or tension sensor within eye-opening 62 or elsewhere, the cable snatching eye-members may be automatically released from body 36 such as by operation of a relay.

In summary, the method and system of the present invention results in positioning submarine 14 in the vicinity of UUV 20 or UUV 20 may move in the vicinity of submarine 14. The distance between UUV 20 and submarine 14 may typically be within about 50 to 100 feet or any other suitable distance. UUV 20 will then typically deploy or is already attached to a short length of cable 22 containing acoustic transducer 26 and buoy 24. Submarine 14 then launches UUV 16, which may be a relatively small body as compared to UUV 20. UUV 16 tows winching cable 18 as UUV 16 receives homing signals from transducer 26. UUV 16 travels toward transducer 26 using automated guidance means that controls steering elements such as fins 46. As UUV 16 engages or slides by transducer 26, capture arms 32 and 38, or other capture arms, will engage cable 22 and guide capture cable 22 into cable snagging eye-member 34. Cable snagging eye-member slides along capture cable 22 until it encounters a jam, such as buoy 24. Then winching cable 18 will be winched back into submarine 14 through torpedo tube 12 and any extensions of torpedo tube 12 that may be added.

Numerous variations of the above method are possible, some of which have already been described. UUV 16 could be launched from a ship. The capture arms could be electrically opened. UUV 16 could have an acoustic receiver/transmitter to receive commands from submarine 14 such as to open the capture arms. UUV 16 could have a sensor to detect capture of cable 22 and to send an acoustic signal back to submarine 14 that cable 22 has been captured. Locks to jettison UUV 16 with respect to cable snagging eye-member 34 could be acoustically activated by a signal from submarine 14. UUV 16 could be programmed to determine if the capture arms passed by cable 22 without snagging cable 22 whereby UUV 16 could be winched back toward submarine 14 and released for a second attempt.

Therefore, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method for retrieving a first untethered submarine tube-retrievable unmanned underwater vehicle (UUV), said untethered submarine tube-retrievable UUV having a capture cable extending therefrom, said capture cable having attached thereto intermediate said first UUV and said capture cable's trailing end a sender transducer unit for producing a homing beacon signal, said sender transducer unit being housed in a pod which additionally serves the purpose of being a first mechanical jam, said capture cable further having attached at its trailing end an element for exerting a cable extending force on said capture cable and which in addition serves as a second mechanical jam, said method comprising the steps of:

attaching a winching cable to a tethered homing signal seeking unmanned underwater vehicle (UUV);

launching said tethered homing signal seeking UUV from a UUV retrieve tube of a submarine with said winching cable being towed by said tethered homing signal seeking UUV;

receiving said homing signal for guiding said tethered homing signal seeking UUV toward said capture cable;

providing one or more capture arms that extend laterally from said tethered homing signal seeking UUV to form one or more respective apexes between said capture arms and a body of said tethered homing signal seeking UUV;

providing a cable snagging eye-member at each of said one or more apexes, each cable snagging eye-member having formed therein a eye-opening of sufficient cross-sectional size to allow said cable snagging eye-member to freely slide along said capture cable when said capture cable is snagged therein;

impinging a capture arm against said capture cable to guide said capture cable to a respective apex and into snagged condition within said eye-opening of said cable snagging eye-member; and retrieving said untethered submarine tube-retrievable UUV by pulling said winching cable to slide said cable snagging eye-member along said capture cable until said cable snagging eye-member engages a one of either of the first or second mechanical jam, whereupon continued pulling hauls said untethered submarine tube-retrievable to into said UUV retrieve tube of said submarine.

2. The method of claim 1 wherein:

said sender transducer unit and said force exerting element at said trailing end of said capture cable singly and collectively presenting less inertial and drag resistance to a force to move them through water than the inertial and drag resistance presented by said untethered submarine tube-retrievable UUV, whereby said cable snagging eye-member will always slide along said capture cable toward a one of either of the first or second mechanical jam.

3. The method of claim 1 wherein said step of attaching said winching cable further comprises:

providing a split in said winching cable with first and second ends;

attaching said first end to a first cable snagging eye-member; and attaching said second end to a second cable snagging eye-member.

4. The method of claim 3 further comprising providing that said first and second cable snagging eye-members are detachable from said tethered homing signal seeking UUV.

5. The method of claim 1 wherein said element for exerting said cable extending force on said capture cable when immersed in water resists motion thereby causing said capture cable to stream behind said tethered homing signal seeking UUV when the latter is in motion.

6. The method of claim 1 further comprising providing that said homing signal is an acoustic signal.

7. The method of claim 1 further comprising providing that said one or more capture arms are spring loaded for automatically extending outwardly.

8. The method of claim 1 further comprising the steps of:

providing that said cable snagging eye-member at each apex is detachably mounted to said body of said tethered homing signal seeking UUV; and detaching said one or more cable snagging eye-members after said capture cable is snagged by a respective cable snagging eye-member but before said untethered submarine tube-retrievable UUV enters said UUV retrieve tube.

9. The method of claim 1 wherein said UUV retrieve tube is a torpedo tube of said submarine and said winching cable is pulled into said torpedo tube from inboard of said submarine.

10. The method of claim 1 wherein said element for exerting a force attached to said trailing end of said capture cable is a buoy to cause said capture cable to generally extend vertically.

11. A system for retrieving a first untethered submarine tube-retrievable UUV, said system comprising:

a submarine UUV retrieve tube;

a capture cable trailing from said untethered submarine tube-retrievable UUV, said capture cable having attached a sender transducer unit for producing a homing beacon signal intermediate said first UUV and the trailing end of said capture cable, said sender transducer unit having a pod which houses said sender transducer unit and which additionally serves the function of being a first mechanical jam, said capture cable further having attached to said trailing end an element for exerting a cable extending force on said capture cable and which additionally serves as a second mechanical jam;

a tethered homing signal seeking UUV carrying a receiver transducer for receiving said homing beacon signal to guide said tethered homing signal seeking UUV toward said homing beacon signal and said capture cable;

a winching cable secured to said tethered homing signal seeking UUV and extendable through said UUV retrieve tube;

a plurality of extendable capture arms mounted to said tethered homing signal seeking UUV for engaging said capture cable, said extendable capture arms in their extended positions being angled with respect to a body of said tethered homing signal seeking UUV for guiding said capture cable to an apex formed between each said extendable capture arm in its extended position and said body; and a plurality of cable snagging eye-members, each cable snagging eye-member being mounted at respective apexes having formed therein an eye-opening of sufficient cross-sectional size to allow said cable snagging eye-member to freely slide along said capture cable when the latter is snagged therein, each cable snagging eye-member being operative to irreversibly admit said capture cable into said eye-opening.

12. The system of claim 11 wherein said sender transducer unit and said force exerting element at said trailing end of said capture cable singly and collectively present substantially less inertial and drag resistance to a pulling force applied to said winching cable than the inertial and drag resistance which said untethered submarine tube-retrievable UUV presents to such a force, whereby upon said capture cable being snagged in a cable snagging eye-member of the plurality, and upon subsequent pulling of said winching cable, the eye-member will slide with respect to the capture cable and jam against a one of either of the first or second mechanical jams and continued pulling will haul said untethered submarine tube-retrievable UUV to said UUV retrieve tube.

13. The system of claim 11 further comprising a Y split in said winching cable to form a first end and a second end for attachment to said tethered homing signal seeking UUV.

14. The system of claim 13 wherein said first end attaches to a first of said plurality of cable snagging eye-members, and said second end attaches to a second of said plurality of cable snagging eye-members.

15. The system of claim 11 further comprising:

said plurality of cable snagging eye-members are respectively detachably mounted to the body of said tethered homing signal seeking UUV;

a corresponding collectively sunderable plurality of fastening arrangements for retaining said plurality of cable snagging eye-members fastened to said body; and said winching cable being secured to said second tethered homing signal seeking UUV by a split cable arrangement connecting to a corresponding plurality of attachment points on said cable snagging eye-members whereby a collective sundering of said plurality of fastening arrangements separates said plurality of cable snagging eye-members from said body of said tethered homing signal seeking UUV.

16. The system of claim 15 wherein each said fastening arrangement of said collectively sunderable plurality of fastening arrangements comprises a shear bolt adapted to shear upon said winching cable having applied thereto a pulling force of a predetermined magnitude less than that necessary to overcome the inertial and drag resistance of said body of said tethered homing signal seeking UUV.

17. The system of claim 11 wherein said element for exerting a force attached to said trailing end of said capture cable is an element which when immersed in water resists application of a motion producing force thereto.

18. The system of claim 11 wherein said element for effecting a force attached to said trailing end of said capture cable is a buoy.

19. The system of claim 11 wherein said tethered homing signal seeking UUV is propelled by a propeller mechanism at a stern end of a tailcone portion of said UUV and has a plurality of fins radially projecting from said tailcone transversely to a longitudinal axis of said tethered homing signal seeking UUV in equiangularly spaced relation to one another, said system further comprising:

the aft edges of said plurality of fins being disposed at an axial position along said tethered homing signal seeking UUV longitudinal axis whereat the tailcone's diameter is greater than that of the circle of revolution of said propeller mechanism;

said plurality of cable snagging eye-members being disposed at an axial position of said longitudinal UUV axis forward of said plurality of fins;

said plurality of cable snagging eye-members including a pair of first and second eye-members aligned with a first and second of said plurality of fins, said first and second fins being disposed on either side of a third intermediate fin; and said winching cable at an outboard end relative to said submarine including a bifurcating split with a crotch of two branches of said bifurcating split being disposed at a rear edge of said third fin.

20. The system of claim 12 wherein said UUV retrieve tube is located in the bow of said submarine and said submarine is operative to propel itself rearwardly to at least assist in application of said pulling force to said winching cable.

* * * * *